United States Patent [19]

Honeyman et al.

[11] Patent Number: 4,585,496

[45] Date of Patent: Apr. 29, 1986

[54] METHOD OF PRODUCING HIGH-DENSITY SLURRY/PRILL EXPLOSIVES IN BOREHOLES AND PRODUCT MADE THEREBY

[75] Inventors: Gordon R. Honeyman, North Bay, Canada; James H. Owen, II, Jefferson City, Mo.

[73] Assignee: E. I. Du Pont de Nemours and Company, Wilmington, Del.

[21] Appl. No.: 710,543

[22] Filed: Mar. 11, 1985

[51] Int. Cl.[4] ..... C06B 45/02

[52] U.S. Cl. ..... 149/21; 149/2; 149/46; 149/47; 149/60; 149/61; 149/62; 149/92; 149/109.6; 102/313

[58] Field of Search ..... 149/109.6, 2, 21, 46, 149/47, 61, 62, 92, 60; 86/20 C; 102/313

[56] References Cited

U.S. PATENT DOCUMENTS 4,036,099 7/1977 French ..... 86/20 C

*Primary Examiner*—Stephen J. Lechert, Jr.
*Attorney, Agent, or Firm*—Diamond C. Ascani

[57] ABSTRACT

The pneumatic loading of essentially free-flowing slurry-bearing ammonium nitrate (AN) prills, i.e., AN prills which carry or support a water gel or water-in-oil emulsion, produces a high-density explosive consisting of the tightly packed whole and crushed slurry-bearing prills. The density of this explosive can be as much as 20% higher than the poured density of the mass of slurry-bearing prills.

23 Claims, No Drawings

METHOD OF PRODUCING HIGH-DENSITY SLURRY/PRILL EXPLOSIVES IN BOREHOLES AND PRODUCT MADE THEREBY

BACKGROUND OF THE INVENTION

1. Field of the Invention

The present invention relates to a method of producing high-density slurry/prill explosives in boreholes, and more particularly to the production of such products by bulk-loading sensitized blends of ammonium nitrate (AN) prills and water-bearing products that contain an inorganic oxidizing salt, e.g., AN, in aqueous solution. The invention also relates to certain blends which are especially adapted to be used as starting materials in the present method, and to products made by the method.

2. Description of the Prior Art

Water-bearing explosives contain an inorganic oxidizing salt, predominantly AN, in aqueous solution, and fuel and sensitizer components. In the type commonly referred to as water gels, the aqueous salt solution is a continuous phase that is thickened or gelled. In the type known as emulsion explosives, the aqueous salt solution is the discontinuous or dispersed phase of a water-in-oil emulsion, the continuous phase of the emulsion being an oil, which is a fuel component. Water-bearing explosives are delivered into boreholes in packaged form, e.g., in bags or cartridges, and in bulk form. Cartridges are dropped, pushed with a loading pole, and pneumatically delivered, while bulk products are pumped.

In recent years, explosives have been developed which comprise a blend of AN prills and a water-in-oil emulsion (see, for example, U.S. Pat. Nos. 4,111,727 (Clay), 4,181,546 (Clay), and 4,555,278 (Cescon and Millet). The blends described in U.S. Pat. No. 4,111,727, which may contain crystalline or flake AN instead of AN prills, are stated to be sort of grout-like materials, largely solid in nature. Of the 10–40% slurry content range disclosed, the 20–35% range is stated to be preferred, and the 30–40% range is described as the preferred embodiment in the working examples. Auger-type delivery means are mentioned. U.S. Pat. No. 4,181,546 describes 40/60 to 60/40 emulsion/AN blends as containing too high a proportion of dry ingredient to be pumpable in conventional slurry pumps, but says that they are deliverable to a borehole by an auger in the same manner as dry ANFO. U.S. Pat. No. 4,555,278 describes pumping blends containing up to about 50 percent prills by weight, and augering blends containing up to about 70 percent prills by weight into packages.

U.S. Pat. No. 4,294,633 (Clay) describes a blasting agent in which a non-aqueous slurry (a solution of AN in methanol or ethylene glycol) partially fills the interstices and pores in and between AN granules to form a plastic solid mass that can be augered or otherwise conveyed through a conduit.

Our co-pending U.S. application Ser. No. 710,542, filed concurrently herewith, describes storage-stable explosive compositions comprising a sensitized blend of solid particulate inorganic nitrate, preferably AN or ANFO prills, and an aqueous slurry comprising a thickened aqueous solution of an inorganic oxidizing salt, preferably AN. Of the blend compositions described in the latter co-pending application, those which contain about 75 percent or more prills by weight are stated to be essentially in the form of a granular mass of free-flowing slurry-bearing AN prills having a higher bulk density and blasting energy than AN prills alone. While this granular product doubtlessly constitutes a valuable explosive product for the blaster to have at his disposal, a granular product of higher loaded density would be of great advantage, especially if it could be produced by a rapid-loading technique. Slurry/prill explosives, including the granular free-flowing slurry-bearing prills, are hybrid products and could be unpredictable relative to their response to handling, environment, etc. Regardless of how high the prill/slurry ratio may be, the presence of the water-bearing component cannot be overlooked and is an over-riding factor in product-handling considerations. Whether the slurry component of the product happens to be a water gel or an emulsion, the physical structure of the blend, and consequently the blend's behavior under a given set of conditions, will depend greatly on the physical structure of the slurry per se and of the prills. These blend characteristics have been unpredictable owing to the fact that the solution phases present in the slurry can undergo change when the slurry is in contact with the prills.

It has been known for many years that dry ANFO prills can be loaded into boreholes pneumatically. However, slurry/prill blends in the form of free-flowing discrete particles have not heretofore been described or suggested, and until now only augering and pumping methods have been proposed for delivering prill blend products into boreholes.

SUMMARY OF THE INVENTION

The present invention provides a method of producing a high-density slurry/prill explosive in a borehole, which method comprises (a) feeding into a pressure vessel a granular mass of essentially free-flowing slurry-bearing ammonium nitrate (AN) prills, e.g., ANFO prills, the slurry borne by the prills being an aqueous slurry containing at least one inorganic oxidizing salt, predominantly AN, in aqueous solution, and the amount of slurry in the granular mass being about 25 percent or less, and preferably about 20 percent or less, of the weight thereof; and (b) conveying the slurry-bearing prills out of the vessel through a loading hose into a borehole by air at a pressure of at least about 200, and preferably at least about 300, kPa, whereby a tightly packed mass of whole and crushed slurry-bearing prills is deposited in the borehole.

The slurry-bearing prills generally have a poured density in the range of about from 0.85 to 1.3 g/cc, and the loaded density of the product is at least about 5–10 percent, and often about 20 or more percent, higher than the poured density.

Although the term "slurry" is more commonly applied to those water-bearing products wherein the aqueous inorganic oxidizing salt solution is a continuous phase (as in water gels, including those in which oil is dispersed or suspended in the continuous aqueous phase), for convenience it is used herein to denote water-in-oil emulsion products as well.

The term "slurry-bearing prills" denotes that in the granular mass used in the method of the invention the water-bearing composition of slurry is carried or supported by the prills, which remain physically separated. This is in contrast to products wherein prills are bound together by a liquid filler.

This invention also provides an explosive composition adapted to be loaded into a borehole by the present method, which composition comprises a granular mass of essentially free-flowing emulsion-bearing ammonium nitrate (AN) prills, the granular mass containing about 18 percent or less of the emulsion by weight, and the emulsion comprising (a) a liquid carbonaceous fuel having components which form a continuous emulsion phase, (b) an aqueous solution of an inorganic oxidizing salt forming a discontinuous emulsion phase dispersed as discrete droplets within said continuous phase, and (c) an emulsifying agent. A preferred composition is one in which the emulsifying agent is non-ionic, and the continuous emulsion phase polar.

The product which is formed in the borehole by the method of the invention comprises a mass of whole and crushed slurry-bearing AN prills packed to a high density, i.e., one which generally is higher than about 1.00 g/cc, usually higher than about 1.10 g/cc, and, with optimum loading conditions and equipment, may reach or even exceed 1.30 g/cc. This is an unusually high-density prill product, of great advantage because of its high bulk blasting energy.

DETAILED DESCRIPTION

In the method of the present invention, AN prills in a blend with as much as about 25 percent of an aqueous slurry (as above-defined) are conveyed into a borehole by an air stream. Surprisingly, the presence of the water-bearing component in the slurry/prill blend, does not adversely affect the behavior of the product in pneumatic loading equipment. Moreover, the phenomenon of an increase in density that can occur when dry AN prills are pneumatically loaded, has unexpectedly been found to be magnified, often significantly, in the present process wherein the density of the loaded mass of slurry-bearing AN prills can be about 10 percent or more higher than its pour density. This density increase can be about double the increase generally observed with dry AN prills. Thus, in addition to the advantage of high poured density offered by the slurry-bearing prills per se (compared to ANFO), the high loaded density of the mass of slurry- bearing prills in the borehole is of great benefit owing to the loaded product's higher bulk blasting energy (energy per unit of volume).

The present method is applied to an explosive comprised of a mass of densified AN prills which carry or support an aqueous slurry containing at least one inorganic oxidizing salt, predominantly AN, in aqueous solution. In one embodiment, the slurry comprises a thickened aqueous solution of the inorganic oxidizing salt(s) blended with AN prills as described in our aforementioned co-pending application. This type of slurry can be an explosive per se, or it can be sensitized by the voids in the An prills, as is described in said application, the disclosure of which is incorporated herein by reference. In one form, this type of slurry can contain an oil emulsifyingly dispersed in the continuous aqueous phase, as occurs when hydroxypropyl guar gum is used as a thickening agent for the aqueous phase. In another embodiment, the slurry can be a water-in-oil emulsion such as one described in U.S. Pat. No. 3,447,978 (Bluhm) or U.S. Pat. No. 4,287,010 (Owen).

In order to achieve a free-flowing characteristic in the slurry-bearing prills, which is important if they are to be loadable pneumatically, the granular mass of prills contains about 25 percent or less slurry by weight. In the case of the water-in-oil emulsion type of slurry, the slurry content should not exceed about 18 percent by weight. With larger amounts of slurry, the particles show a greater tendency to agglomerate, thereby forming a non-granular product which is unsuitable for pneumatic loading.

The emulsion/AN blends which can be used herein include those in which the water-in-oil emulsion has a polar continuous phase, e.g., those employing non-ionic emulsifying agents such as sorbitan mono-oleate. Although we do not intend that our invention be limited by theoretical considerations, it is our belief that the salt crystallization that tends to occur more rapidly in the discontinuous aqueous phase of water-in-oil emulsions which have a polar continuous phase may be beneficial in blends of low emulsion content (about 18 percent or less) by forming a smooth coating on the AN prills, which keeps the emulsion-laden prills free-flowing.

The prills used in the method of the invention and present in the product of the invention are AN prills, ANFO prills, or a combination thereof. ANFO prills are preferred. AN prills are used with slurries that are supplied with sufficient additional fuel to oxygen-balance the AN prills. The poured density of the mass of slurry-bearing AN prills used in the present method depends on the bulk density of the AN or ANFO prills used and the specific slurry/prill weight ratio. Based on prill bulk densities in the range of about from 0.70 to 0.85 g/cc and a slurry content of 5 to 25 percent by weight, the pour density of the mass of slurry-bearing prills generally will be in the range of about from 0.85 to 1.3 g/cc. The loaded density of the product formed will depend somewhat on the quality and integrity of the prills, and on the specific pneumatic loader used and loading conditions such as air pressure, diameter and length of the loading hose, hole diameter, and standoff distance between the exit end of the hose and the prill deposit point. Generally the loaded density will be at least about 5–10 percent higher than the poured density, and often can be about 20 percent higher or more.

The sensitivity of the slurry-bearing prills as loaded into a borehole by the method of the invention, i.e., the ability of the loaded product to be detonated by commonly used initiating devices, is a function primarily of the prill component, the slurry acting essentially as a density-enhancer. Therefore, while the slurry may itself be in a sensitized condition, e.g., it may be a water gel or emulsion explosive, a self-explosive slurry is not required inasmuch as the void volume of the prills can constitute the sole sensitizer for the blend product. Thus, the slurry per se need not contain a chemical sensitizer or a sensitizing amount of dispersed gas bubbles or voids, which are commonly used for sensitization. However, to assure a sufficiently sensitive blend, the AN or ANFO prills used should be those which are normally effective when used alone as a blasting agent. Typically, these prills have a particle density of 1.35 to 1.52 g/cc, a prill void volume of 10.0 to 18.5%, and a poured density of 0.70 to 0.85 g/cc.

A variety of pneumatic borehole loaders are available for charging ANFO into boreholes, and any of these can be employed in the present method to convey slurry-bearing prills into the borehole. In general, these loaders all have a cylindrical stainless steel tank which can be filled through an opening at the top. Once filled, this opening can be sealed off and the tank pressurized with air. The bottom of the tank is conically angled, e.g., at 45° or more, down to a ball valve where the product is discharged. A pressure regulator is used to control the pressure to the tank through a primary valve arrangement. A secondary valve arrangement may be utilized to provide a venturi effect at the bottom of a discharge elbow to assist in moving the product through the loading hose and into the borehole.

Owing to the higher densities of the slurry-bearing prills when compared to ANFO, and also to reduced flow properties which may be encountered therewith especially in the higher slurry/prill ratios with certain types of loaders, the air pressures required in the present process normally are higher than those customarily employed to load ANFO prills. Although pressures as low as about 200 kPa may be used especially to load slurry-bearing prills whose slurry content is minimal, e.g., about 5 percent, pressures of at least about 300 kPa generally are more suitable and give better results in terms of higher loaded densities. Pressures as high as about 700 kPa, near the capability limits of many loaders, can be used. Pressures over most of the range which is useful in the present process normally are avoided in loading ANFO because of the product blowback that occurs therewith, a condition which is undesirable in underground mining operations.

As was stated previously, the loaded density of the product depends not only on the air pressure, but also on such variables as the borehole diameter, the length and diameter of the loading hose, the slurry/prill ratio, and the standoff distance between the discharge end of the loading hose and the loaded column of product in the hole. Optimization of the loaded density requires finding a suitable combination of these variables, e.g., reducing the hose length and/or diameter, or standoff distance if a higher density is desired in loading a given slurry/prill blend in boreholes of a given diameter.

In the following illustrative examples, parts and percentages are by weight.

EXAMPLE 1

A slurry (water gel sol) of the following composition was prepared:

| Ingredient | Parts* | |
|---|---|---|
| AN | 16.7 | |
| SN | 34.2 | |
| MMAN | 35.1 | |
| Water | 9.3 | guar/water = 0.18 |
| Guar gum** | 1.7 | |
| Perlite | 1.0 | |
| Ethylene glycol | 2.0 | |

*Per 100 Parts of slurry
**0.6 part of Type "4603", a Celanese product, and 1.1 parts of "Galactasol 245-D", a Henkel product having a retarded thickening action A mixture of the guar gum and 16% of the SN was mixed into a 50°-55° C. mixture of a 79% aqueous solution (liquor) of MMAN and the ethylene glycol in a mixing vessel, and mixing was continued for about 3 minutes until thickening was observed. Then the perlite, the remaining SN, and the AN (2 grained) were mixed in sequentially. The viscosity of the resulting sol was 110 poise, as measured with a Brookfield viscometer at 25° using a No. 6 spindle at 20 rpm. Its density was 1.21 g/cc.

The explosive sol was packaged in a 12.7-cm-diameter, low-density-polyethylene bag and stored for about 24 hours to allow the completion of hydration. Thereafter, the sol was poured into ANFO prills in a cement mixer and blended therewith to produce a 15/85 slurry/ANFO blend. The ANFO prills, before blending, had a poured density of 0.83 g/cc. The blended product, which had a poured density of 0.92 g/cc, was dry and granular, consisting of essentially free-flowing (pourable) discrete particles.

The blend was packaged in a 12.7-cm-diameter, low-density-polyethylene bag and stored at ambient temperature, (−18° C. to −6° C.) after which time it was loaded into 3-meter-long steel pipes with a 50-kg-capacity Teledyne ANFO loader at an air pressure of 420 kPa through a 15-meter loading hose having a 1.9-cm inner diameter. The loader had a tank with a conical bottom having a 45° conical angle, leading to a 3.8-cm ball valve where the blend was discharged. The loaded densities and detonation velocities (initiated with a No. 12 electric blasting cap) were as follows:

| | 4.1-cm-diam. Pipe | | 3.5-cm-diam. pipe | |
|---|---|---|---|---|
| Blend Age | Loaded Density g/cc | Detonation Velocity m/sec | Loaded Density g/cc | Detonation Velocity m/sec |
| 1 day | 0.98 | 3097 | 1.02 | 3097 |
| 3 weeks | 1.10 | 3300 | 1.06 | 2870 |
| 5 weeks | 1.07 | 3848 | 1.12 | 3298 |

When the blended product was loaded in the same manner in 4.4-cm-diameter holes in an underground mine face over a period of 6 to 15 days after blending, the average loaded densities of 27-36 holes were 1.03, 1.14, 1.14, 1.11, 1.17, 1.14, and 1.15 g/cc (each value represents the average of the holes loaded on a given day). The fragmentation obtained surpassed that usually achieved with ANFO alone.

The loaded density usually achieved when the same ANFO (poured density 0.83 g/cc) used to make the above blend is loaded into 4.1-cm-diameter pipes under the above loading conditions is about 0.95 g/cc. This is a density increase of only about 14%, whereas the density increase achieved when the slurry-bearing prills were loaded under approximately the same conditions was as high as 27%.

EXAMPLE 2

A water-in-oil emulsion consisting of an 80% aqueous AN liquor as the dispersed phase in an oil continuous phase was prepared. The emulsion contained 88.28% AN, 10.06% oil ("Rando" oil), and 1.66% sorbitan monooleate (SMO), an emulsifier. The AN liquor at a temperature of 70° C., the SMO, and one-third of the oil were added to a turbine blender running at 200 rpm. The pH was 5.0. The remainder of the oil was added gradually at 30-second intervals. The mixer was shut off for 1.5 minutes, and then re-started at 200 rpm, whereupon an emulsion formed. The density of the emulsion was 1.34 g/cc; its viscosity was 1700 poise. It could not be detonated with a 0.45-kg cast primer after one day confined in a 15-cm-diameter steel pipe at 5° C.

The unsensitized emulsion and ANFO prills were blended in a cement mixer to form a 15/85 emulsion-/ANFO granular blend having a poured density of 0.91 g/cc. These emulsion-bearing prills were loaded after one week's storage into a 50-mm inner diameter steel pipe 3 meters long, using the same loading conditions as described in Example 1. The loaded density was 1.07 g/cc (a 17.5% increase), and the loaded product detonated at 3790 m/sec when initiated with a No. 12 electric blasting cap.

After six weeks of storage, the product was loaded into the same-diameter pipe under the above-specified conditions. Again the loaded density was 1.07 g/cc. The detonation velocity was 3628 m/sec.

We claim:

1. A method of producing a high-density slurry/prill explosive in a borehole comprising
   (a) feeding into a pressure vessel a granular mass of essentially free-flowing slurry-bearing ammonium nitrate (AN) prills, said slurry borne by said prills being an aqueous slurry containing at least one inorganic oxidizing salt in aqueous solution, and the amount of slurry in said granular mass being about 25 percent or less of the weight thereof; and
   (b) conveying said slurry-bearing prills out of said vessel through a loading hose into a borehole by air at a pressure of at least about 200 kPa, whereby a tightly packed mass of crushed and whole slurry-bearing prills is deposited in said borehole.

2. A method of claim 1 wherein said free-flowing slurry-bearing AN prills have a poured density in the range of about from 0.85 to 1.3 g/cc, and the loaded density of the product deposited in said borehole is at least 5 percent higher than the poured density.

3. A method of claim 1 wherein said AN prills are ANFO prills.

4. A method of claim 1 wherein said slurry comprises a thickened aqueous solution of said inorganic oxidizing salt(s).

5. A method of claim 4 wherein said slurry contains a thickener which is crosslinked.

6. A method of claim 1 wherein said slurry is a water-in-oil emulsion.

7. An explosive composition comprising a granular mass of essentially free-flowing emulsion-bearing AN prills, said granular mass containing about 18 percent or less of said emulsion by weight, and said emulsion comprising (a) a liquid carbonaceous fuel having components which form a continuous emulsion phase, (b) an aqueous solution of an inorganic oxidizing salt forming a discontinuous emulsion phase, and (c) an emulsifying agent.

8. An explosive composition of claim 7 wherein said emulsifying agent is non-ionic.

9. An explosive composition of claim 8 wherein said emulsifying agent is a sorbitan fatty acid ester.

10. An explosive composition of claim 7 wherein said emulsion-bearing prills are sensitized by voids in said prills.

11. An explosive composition of claim 10 wherein said emulsion-bearing prills are additionally sensitized by dispersed gas bubbles or voids in said emulsion.

12. In a borehole, an explosive composition comprising a tightly packed mass of crushed and whole slurry-bearing AN prills, said slurry containing at least one inorganic oxidizing salt in aqueous solution, the amount of slurry in said mass being about 25 percent or less of the weight thereof.

13. An explosive composition of claim 12 wherein said slurry comprises said salt solution as a continuous aqueous phase that is thickened.

14. An explosive composition of claim 13 wherein said thickened aqueous phase is gelled.

15. An explosive composition of claim 13 wherein an oil is emulsifyingly dispersed in said continuous aqueous phase.

16. An explosive composition of claim 12 wherein said slurry-bearing prills are sensitized by voids in said prills.

17. An explosive composition of claim 16 wherein said slurry-bearing prills are additionally sensitized by a chemical sensitizer in said slurry.

18. An explosive composition of claim 17 wherein said chemical sensitizer is a nitrogen-base salt of an inorganic oxidizing acid.

19. An explosive composition of claim 12 wherein said slurry comprises a water-in-oil emulsion.

20. An explosive composition of claim 19 wherein said slurry-bearing prills are sensitized by voids in said prills.

21. An explosive composition of claim 20 wherein said slurry-bearing prills are additionally sensitized by dispersed gas bubbles or voids in said emulsion.

22. An explosive composition of claim 19 wherein the amount of said emulsion in said mass is about 18 percent or less of the weight thereof.

23. A method of producing a high-density slurry/prill explosive in a borehole comprising
   (a) combining AN prills and a water-bearing slurry product as defined herein so as to form a granular mass of essentially free-flowing slurry-bearing AN prills containing about 25 percent or less slurry by weight;
   (b) feeding said mass of slurry-bearing AN prills into a pressure vessel; and
   (c) conveying said slurry-bearing prills out of said vessel through a loading hose into a borehole by air at a pressure of at least about 200 kPa, whereby a tightly packed mass of crushed and whole slurry-bearing prills is deposited in said borehole.

* * * * *